United States Patent [19]

Kossler

[11] 4,025,358

[45] May 24, 1977

[54] PROCESS FOR CURRENTLESS SEPARATION OF A NICKEL LAYER FROM OBJECTS OF LIGHT METAL

[75] Inventor: Albert Kossler, Bad Wimpfen, Germany

[73] Assignee: Audi NSU Auto Union Aktiengesellschaft, Neckarsulm, Wurtt, Germany

[22] Filed: Oct. 1, 1975

[21] Appl. No.: 618,558

[30] Foreign Application Priority Data

Oct. 11, 1974 Germany ..... 2448526

[52] U.S. Cl. ..... 134/3; 134/22 R; 134/25 R; 134/41

[51] Int. Cl.[2] ..... B08B 3/08

[58] Field of Search ..... 134/3, 41, 22 R, 25 R, 134/25 A; 252/79.2, 101, 142; 156/18

[56] References Cited

UNITED STATES PATENTS

| | | | |
|---|---|---|---|
| 1,994,499 | 3/1935 | Boller | 252/79.2 X |
| 2,978,366 | 4/1961 | Harwig et al. | 134/3 |
| 3,367,874 | 2/1968 | Haviland et al. | 252/79.2 |
| 3,856,694 | 12/1974 | Becking | 134/3 X |
| 3,878,006 | 4/1975 | Rice | 252/79.2 X |

*Primary Examiner*—S. Leon Bashore
*Assistant Examiner*—Marc L. Caroff
*Attorney, Agent, or Firm*—Kane, Dalsimer, Kane, Sullivan and Kurucz

[57] ABSTRACT

A process for currentless separation of a nickel layer from nickel-coated objects of light metal. An acid bath is used consisting of nitric acid and hot water in which metallic copper is placed.

2 Claims, 1 Drawing Figure

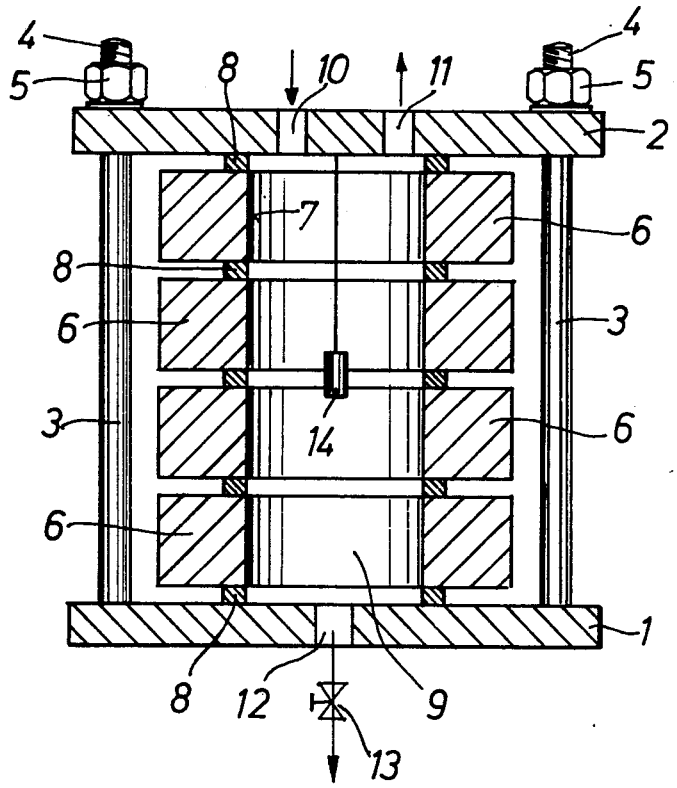
4
5
8
10
11
4
5
2
7
6
8
6
3
3
14
6
6
1
8
12
9
13

PROCESS FOR CURRENTLESS SEPARATION OF A NICKEL LAYER FROM OBJECTS OF LIGHT METAL

BACKGROUND OF THE INVENTION

Defects may occur in the coating process as well as in any subsequent mechanical working of the surface of nickel-coated objects of light metal. The defects may consists for example in an unsatisfactory adhesion of the nickel layer to the light metal, or in polishing defects, affecting the dimensions of the coated object. Also, in service the nickel layer of the object may be damaged or chipped, rendering it unfit for use. To restore such articles to a useable state, it is necessary to remove the nickel layer, either galvanically or in a current-less procedure, so that the article may be recoated.

It is known that nickel layers may be removed with the use of a bath containing sulfuric and nitric acids. But this process requires a very long reaction time and is therefore not practical. Also special precautions are necessary in mixing the nitric acid with the sulfuric acid.

SUMMARY OF THE INVENTION

The problem of the invention is to provide a process for currentless separation of the nickel layer of nickel coated objects from the light metal, this separation being accomplished in a relatively short time and with limited outlay.

This problem is solved according to the invention by using, instead of a bath containing sulfuric and nitric acids, a bath containing only nitric acid and hot water, into which metallic copper is introduced.

Surprisingly, the process according to the invention reduces to a fraction the time required to remove the nickel layer as compared to known processes, since copper metal greatly accelerates the reaction. The process is rendered cheaper by the use of hot water rather than sulfuric acid, avoiding the mixing of two acids as required in known processes.

The bath advantageously consists of nitric acid of technical density 1.40 and hot water at about 70° to 80° C. in a volume ration of 1:1.

Use of hot water immediately brings about the reaction temperature required to start reaction of the nitric acid with the nickel and the metallic copper.

The reaction being exothermic, a temperature of about 50° C. is established during the process. This temperature is maintained for the duration of the reaction. When the nickel has dissolved, the reaction breaks off, as in indicated by a decline in temperature of the bath. The reaction slows down abruptly if nickel is still present when the copper metal has already been dissolved. In that case metallic copper must be added to the bath once more. Experiments have shown that to remove a layer containing 10 cc of nickel, about 30 g metallic copper is required.

BRIEF DESCRIPTION OF THE DRAWING

A device for practicing the process according to the invention is shown in the drawing.

DESCRIPTION OF THE PREFERRED EMBODIMENT

The device consists of a base plate 1, a cover plate 2 and stay bolts 3 to which cover plate 2 is applied and on the upper ends of which are provided threaded sections 4 to accommodate nuts 5. Between plates 1 and 2, four ring-shaped pieces 6 are arranged stacked one above another, their inner faces 7 coated with the nickel to be removed. Between neighboring pieces 6 as well as between the top and bottom pieces and the adjacent plates 1 or 2, are provided annular packings 8. When the screw nuts 5 are tightened, ring-shaped pieces 6 are drawn together between plates 1 and 2 to form a sealed interior chamber 9. Cover plate 2 is provided with an input opening 10 for the bath of nitric acid and hot water and with an outlet opening 11 for escape of gases resulting from the reaction. Base plate 1 has a discharge opening 12, closeable by valve 13 schematically represented. A piece of copper 14 is suspended in the interior space 9.

The total area of the inner faces 7 of ring-shaped pieces 6 might for example be 1800 $cm^2$, and the thickness of layer 0.25 mm; from this we get a total quantity of 45 cc of nickel to be dissolved off. For this, a bath consisting of 7 liters nitric acid and 7 liters water at a temperature of 70°–80° C. are introduced into the inner chamber 9. The quantity of metallic copper required to expedite the reaction is about 120 g. During reaction of the nitric acid with the nickel and the copper, a bath temperature of about 50° C. sets in. After about 15 minutes the nickel layer is dissolved off, the nickel and copper going into the solution as nickel and copper nitrate. The object so denickeled may after thorough washing with water be coated with nickel again without further treatment.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. Process for currentless separation of a nickel layer from the inner surfaces of ring-shaped objects of light metal comprising: stacking the objects one on another with interposition of annular packings between adjacent stacked objects and clamping the objects together to form a sealed interior chamber, introducing into the chamber a bath containing nitric acid, water at 70° to 80° C and metallic copper in amounts effective to dissolve the nickel layer with the nitric acid reacting with the nickel and the copper, the reaction gases escaping from the chamber and the bath being discharged from the chamber upon termination of the reaction.

2. Process according to claim 1 wherein the nitric acid has a density of 1.40 and the volume ratio between the nitric acid and the water is 1:1.

* * * * *